United States Patent [19]

Cederholm et al.

[11] Patent Number: 4,769,098

[45] Date of Patent: Sep. 6, 1988

[54] APPARATUS AND METHOD FOR FORMING A BUTT SPLICE

[75] Inventors: Roger Cederholm, Loves Park; John R. Martin; David L. Seaberg, both of Rockford, all of Ill.

[73] Assignee: Martin Automatic, Inc., Rockford, Ill.

[21] Appl. No.: 95,014

[22] Filed: Sep. 10, 1987

[51] Int. Cl.[4] ..... B65H 19/14; B65H 19/18; B65H 69/06

[52] U.S. Cl. ..... 156/159; 156/267; 156/304.3; 156/504; 156/505; 156/510; 242/56 R; 242/58.3; 242/58.4; 242/58.5

[58] Field of Search ..... 156/159, 304.3, 267, 156/502, 504, 505, 510; 242/56 R, 58.1, 58.3, 58.4, 58.5

[56] References Cited

U.S. PATENT DOCUMENTS

| | | | |
|---|---|---|---|
| 3,554,842 | 1/1971 | Byrt | 156/505 |
| 3,694,416 | 3/1972 | Chapman | 156/523 |
| 3,773,598 | 11/1973 | Taeffner et al. | 156/505 |
| 3,819,454 | 6/1974 | Mason | 156/505 |
| 3,886,031 | 5/1975 | Taitel | 156/505 |
| 3,939,032 | 2/1976 | Taitel et al. | 156/159 |
| 3,957,567 | 5/1976 | Purcell et al. | 156/523 |
| 4,157,934 | 6/1979 | Ryan et al. | 156/505 |
| 4,190,475 | 2/1980 | Marschke | 156/504 |
| 4,190,483 | 2/1980 | Ryan et al. | 156/505 |
| 4,260,444 | 4/1981 | Fowler | 156/271 |
| 4,284,463 | 8/1981 | Wright | 156/505 |
| 4,310,378 | 1/1982 | Bosco | 156/518 |
| 4,526,638 | 7/1985 | Clements | 156/159 |
| 4,629,531 | 12/1986 | Katroka | 156/504 |
| 4,645,558 | 2/1987 | Sato | 156/504 |
| 4,652,329 | 3/1987 | Focke | 156/504 |

OTHER PUBLICATIONS

Weiss, Herbert L., "Rotogravure And Flexographic Printing Presses" (1985), pp. 340–342.

*Primary Examiner*—Michael Wityshyn
*Attorney, Agent, or Firm*—Allegretti & Witcoff

[57] ABSTRACT

The disclosed butt splicing apparatus and method is adapted to be used with rolls of material supported on turret-type roll unwind stands. A splicer embodying the invention includes a nip assembly, a new web preparation assembly, a new web and tape holding assembly, and a web cutting and adhering assembly. The nip assembly serves to clamp the expiring web during a splicing operation. The new web preparation assembly serves to prepare the leading end of the new web for the splicing operation. The new web and tape holding assembly serves to hold a portion of the new web, immediately upstream of its leading end, and to hold a strip of adhesive tape in preparation for the splicing operation and during the splicing operation itself. The web cutting and adhering assembly serves to cut the expiring web during the splicing operation and to cause the cut part of the trailing end of the web and the leading end of the web to adhere to the adhesive tape simultaneously as the cutting of the expiring web occurs.

16 Claims, 7 Drawing Sheets

10
158
156
156
158
66
142
142
58
26
140
140
136
132
116
64
122
96
56
134
154
106
82
60
14
72
74
68
76
28
146
168
62
32
78
52
164
14
12
46
12
48
34
14

APPARATUS AND METHOD FOR FORMING A BUTT SPLICE

BACKGROUND OF THE INVENTION

The present invention relates to methods and apparatus to form a butt splice between adjacent ends of webs of material. Specifically such butt splices are usable to join together the leading end of a web from a new roll of material to a trailing end of a web which is from an expiring roll of material and which is being run, downstream from the expiring roll, under tension along a predetermined path of travel that includes a running web storage means. More particularly, the present invention relates to methods and apparatus to form a butt splice of the type described where the new and expiring rolls are supported on a roll unwind stand, where the expiring roll is supported in a first roll supporting position on the roll unwind stand, where the new roll is initially supported in a second, roll supporting position on the roll unwind stand above the plane of the path of the web from the expiring roll as the web from that expiring roll runs through the splicer, and where the new roll is moved, after the web has begun to be run off of the new roll, to the first roll supporting position. Examples of such running web storage means and roll unwind stands are a conventional festoon and a turret type roll unwind stand, respectively.

In the past, several different types of butt splicers have been used with turret type, roll unwind stands. These include so-called: "Festoon Butt Splicers," "Flying Lap-Butt Splicers," "Bobst Butt Splicers," and "Travelling Knife Butt Splicers." These types of splicers are generally described in a book entitled: "Rotogravure and Flexographic Printing Presses" by Herbert L. Weiss, that was published in 1985 by Converting Technology Corp., 4771 N. Bartlett Drive, Milwaukee, Wis. 53211. The description of such splicers, found on pages 340–342 of this book, are incorporated herein by reference.

A splicer embodying the present invention is intended to replace an existing butt splicer, Model No. M 44-3, that was manufactured by the Miehle Company of Chicago, Ill. In this existing butt splicer, the leading end of the web from the new roll is fed into the splicer and held, by a vacuum bar, above the web from the expiring roll running along a substantially horizontal path of travel through the splicer. Tape bars are mounted above and below the webs. To prepare for a splice, the operator must slide out the two tape carriers, apply tape to these carriers and then re-slide them back into the splicer. Aligned upper and lower shearing blades are positioned opposite each other above and below the webs. The tape bars are connected with the shearing blades to form upper and lower assemblies that are movable vertically by a first pair of air cylinders. The vacuum bar holding the new web is also mounted as a part of the upper assembly and is supported so that it can be rotated out of its initial, new web holding position.

When a splice is initiated, clamp bars, actuated by other air cylinders, clamp the web from the expiring roll downstream from the point where the splice is to be made and clamp the webs from the new roll and the expiring roll upstream from the splice. The shearing blades are then moved vertically by the first pair of air cylinders to cut the entire new and old webs, at one time, on a common line. The shearing blades are then retracted and indexed so that the tape bars are now located directly opposite each other above and below the cut line of the new and expiring webs. The tape bars are then brought together by the first pair of the air cylinders. The vacuum bar, still holding the trimmed downstream end of the new web, is rotated from its initial position to keep this trimmed end out of the taping process. After the taped bars have met and forced the tapes together over the splice, the taped bars are retracted, and indexed back to their original positions. Thereafter the clamp bars are retracted and the spliced web begins moving along its path of travel.

This existing splicer has several significant disadvantages. The shearing blades must be perfectly aligned across the entire width of the new and expiring webs or they will not shear properly. This will result in a missed splice. To a large extent, the shearing blades rely on the piston rods and bushings for proper alignment. As the bushings wear, it becomes increasingly difficult to hold this needed alignment between the shearing blades.

Further, after the new and expiring webs are sheared, their sheared ends tend to drop down during the indexing of the shearing blades and the tape bars. This increases the chances of the ends of the webs being improperly aligned when brought back up during the taping process. Enormous pressure is also required to tape the webs because the tape is applied across the entire width of the webs at the same time.

The existing splicer is relatively slow. A number of extra mechanical movements are involved in making a splice. Moreover, the extra mechanical movements require many movable parts and mechanisms that are subject to wear and are difficult to control and service. Additionally, there is less operator safety due to the "guillotine" nature of the shear blades and taping assemblies.

More specifically, the existing splicer is difficult to set up, and an operator must have significant skills and experience to do it properly. The shearing blades were quite expensive, and routinely have to be changed. Additionally, the time required to complete a splice is about four seconds. This, of course, reduces the speed at which the splice may be performed with a given amount of web storage.

SUMMARY OF THE INVENTION

In principal aspect, the present invention relates to an improved apparatus and method for consistently forming an accurate butt splice between the trailing end of a web from an expiring roll to the leading end of a web from a new roll. The improved apparatus and method are particularly adapted for use in forming butt splices with webs from rolls supported on a roll unwind stand, such as, for example, a turret-type, roll unwind stand, where the expiring roll is supported in a first, roll supporting position on the roll unwind stand, where the new roll is initially supported in a second, roll supporting position on the roll unwind stand above the path of travel of the web running from the unexpired roll, and where the new roll is moved, after the web has begun to be run off the new roll, to the first roll support position. The use of such roll unwind stands dictate that nothing may be positioned in front of the entrance to the splicer.

Splicers embodying the present invention are able to butt splice new and expiring webs in a relatively short time, for example, in about one-half of a second, thereby minimizing the length of time that the portion of the web running through the splicer has to be stopped. This, of course, permits the web to be run at much higher speeds than permitted in prior splicers. Another important advantage of the present invention is that splicers embodying the invention may have a relatively uncomplicated, simple construction and do not require the application of tremendous forces to the tape and cut ends of the web in order to achieve a satisfactory splice. Additionally, a splicer embodying the present invention can be set up for a splice by an operator having limited experience and skills. The operator does not have to be present at the time the splice occurs. Use of the splicer of the present invention should, as a practical matter, substantially eliminate operator error as a cause for missed splices and should greatly enhance operator safety.

Because of the simplicity of its construction, a splicer embodying the present invention may be manufactured for substantially less than the existing splicer noted above. Specifically, the cost of the splicer embodying the present invention is approximately one-half of that of the existing splicer described above. Additionally, since the splicer embodying the present invention does not require the heavy shearing blades and does not require the continual, precise alignment of the shearing blades and taping heads as in the existing splicer, the costs of maintaining the splicer embodying the present invention should be much less than that of the existing splicer.

Accordingly, it is a important object of the present invention to provide an improved apparatus and method for forming a butt splice between the leading end of a web from a new roll and the trailing end of a web from an expiring roll that is being run, at a relatively high speed, along a predetermined path of travel that includes a substantially horizontal section through the splicer and that further includes a running web storage means, such as in a festoon, and then a web utilizing means, such as a printing press, downstream from the splicer. A related object of the present invention is to provide a butt splicing apparatus and method as described which may be used with roll unwind stands, such as turret-type roll unwind stand, where the expiring roll is supported in a first, roll supporting position on the roll unwind stand, where the new roll is initially supported in a second, roll supporting position on the roll unwind stand above the path of travel of the web from the existing roll, and where the new roll is moved, after the splice has been made, to the first roll support position.

Another object of the present invention is to provide an improved butt splicing apparatus and method as described wherein the new web is initially prepared for a splice by: holding a leading portion of the new web, in a first position, by means of a web holding assembly above the substantially horizontal section of the path of travel; moving a new web preparation assembly to a first position, adjacent to the held portion of the new web; trimming the leading end of the new web along a cutting edge of an anvil carried by the new web preparation assembly so that the leading end is a preselected distance downstream from the held portion of the new web; and then moving the new web preparation assembly to a second position remote from the new and expiring webs. A related object of the present invention is to provide an improved butt splicer apparatus and method as described which includes means for holding a strip of adhesive tape, adhesive face out, that has a length substantially equal to the width of the webs from the new and expiring rolls, and wherein the tape holding means may be moved between a first position where the adhesive tape is remote from the leading end of the new web and a second position where the adhesive tape overlies and is adjacent to the portions of the new and expiring webs to be spliced.

Still another object of the present invention is to provide an improved apparatus and method as described wherein after the portion of the expiring web in the splicer is brought to a rapid stop, the held portion of the new web is moved from its first position to a second position where it is above and closely adjacent to the stopped portion of the expiring web, and the means for holding the adhesive tape is moved to its second position where the strip of adhesive tape overlies the leading end of the new web and the stopped portion of the expiring web. A related object of the present invention is to provide an improved butt splicing apparatus and method as described wherein after the held portion of the new web and the strip of adhesive tape have been moved to their second positions, a web cutting and adhering assembly rapidly cuts the stopped portion of the expiring web, from one side edge of the web to the other, along a line which lies in the vertical plane that also contains the trimmed leading end of the new web (that is, the vertical plane including the cutting edge of the anvil carried by the new web preparation assembly when the new web preparation assembly is in its first position); and wherein as the cutting and adhering assembly rapidly moves across the stopped portion of the expiring web, the cut part of the trailing end of that web, immediately behind the point of cutting, is simultaneously adhered to the vertically adjacent downstream portion of the face of the adhesive tape. A still further related object of the present invention is to provide an improved butt splicing apparatus and method as described wherein as the cutting and adhering assembly moves across stopped portion of the web from the expiring roll, it also simultaneously adheres the adjacent upstream portion of the leading end of the new web to the vertically adjacent upstream portion of the face of the adhesive tape.

Yet another object of the present invention is to provide an improved butt splicing apparatus and method as described wherein the cutting of the stopped portion of the expiring web by the cutting and adhering assembly results from the cooperation between a horizontally disposed knife blade and a sharpened beveled edge of a rotatable first wheel, wherein the cut part of the trailing end of the expiring web is pressed up against the vertically adjacent downstream portion of the face of the adhesive tape by the upper peripheral surface of the first wheel, and wherein the upper peripheral surface of a second wheel, having an axis rotation parallel to that of the first wheel and being positioned just upstream from the first wheel, presses the leading end of the new web, that is adjacent to the cut part of the expiring web, up against the vertically adjacent upstream portion of the face of the adhesive tape.

These and still other objects, advantages and aspects of the present invention are more fully set forth in the detailed description of the preferred embodiment of the present invention which follows.

DESCRIPTION OF THE DRAWINGS

In the detailed description of the invention which follows, reference will be made to the accompanying drawings comprised of the following figures.

DETAILED DESCRIPTION OF THE PREFERRED EMBODIMENT

Figure 1:
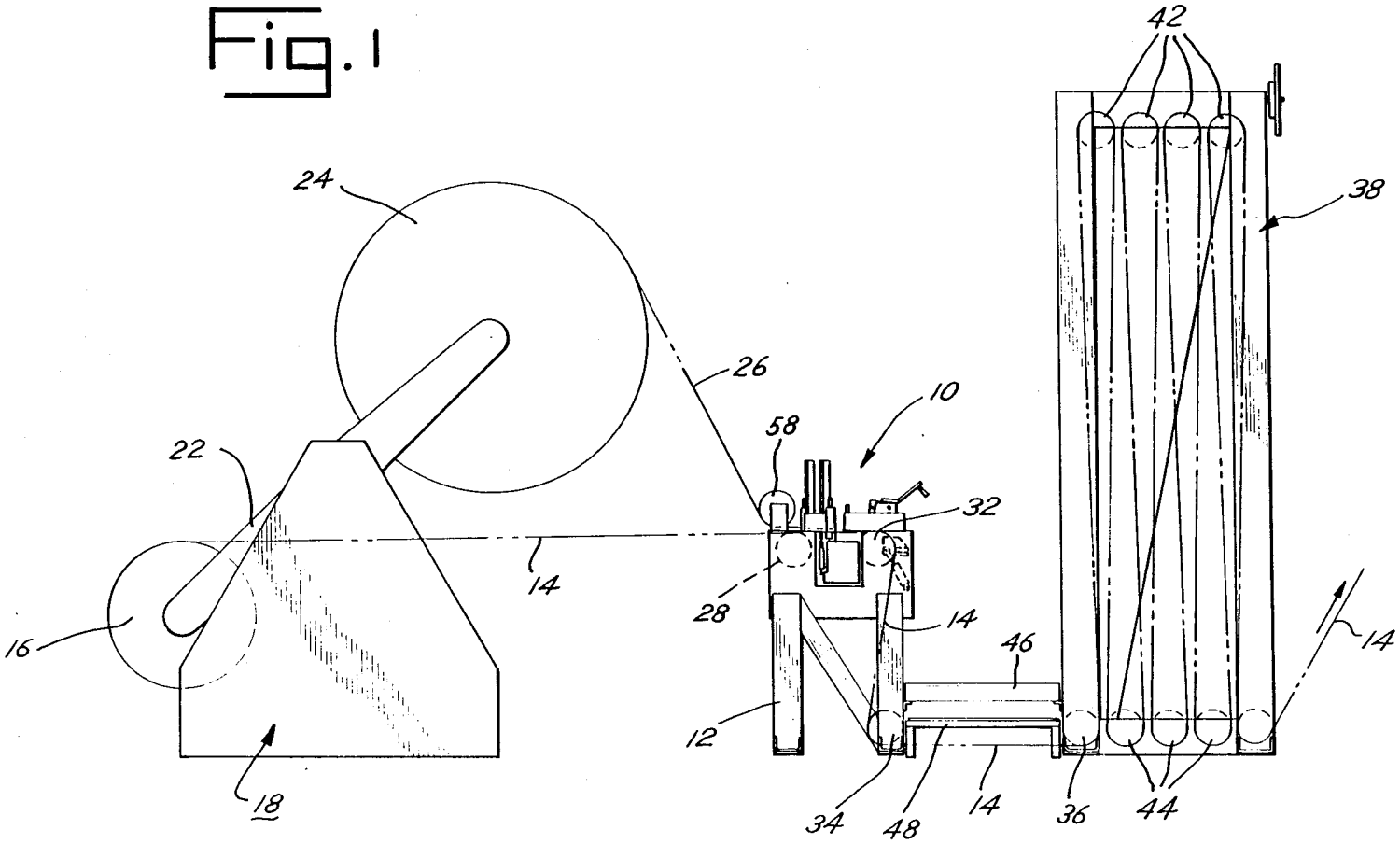
FIG. 1 is a schematic view of a roll unwind stand, a splicer embodying the present invention, and a festoon.

Referring first to FIG. 1, a splicer embodying the present invention is generally shown at 10. The splicer is positioned and supported above the floor on a set of legs 12.

A web 14 from an expiring roll 16 of material is supported on a conventional turret type, roll unwind stand, shown generally at 18. More specifically, the web 14 moves along a substantially horizontal path of travel from the expiring roll 16 to the splicer 10 while the roll 16 is supported on one end of a conventional unwind arm assembly 22 as shown in FIG. 1. This assembly 22 is connected, midway between its ends, to the unwind stand 18 and is adapted to be selectively pivoted about its point of connection with the stand. A new roll 24 of material is supported on the other, opposite end of the arm assembly 22. Conventional roll braking means, not shown, are included on the ends of the arm assembly 22 and may, upon receipt of a signal, be utilized to stop the rotation of the rolls and thus stop the webs from running off the rolls.

A web 26 is led from the new roll 24 to the splicer 10 in preparation for a splice. When this is done, the path of travel of the web 26 from the roll 24 to the splicer 10 is at an angle to the horizontal. After a splice has been made, such that the web 14 is no longer being fed from the roll 16 to the splicer, another new roll of material will then be supported on the one end of arm assembly 22 in place of the old expiring roll 16. Thereafter, the new roll 24 will be moved to the position now occupied by the expiring roll 16 and the other new roll will be supported where the roll 24 is shown in FIG. 1. For this reason, nothing can be positioned at the upstream entrance to the splicer 10 or otherwise be disposed between the webs 14 and 26 as shown in FIG. 1.

Generally speaking, the materials on the rolls 16 and 24 should be the same to assure that their webs can be properly spliced by the splicer 10. A variety of materials can, however, be spliced by the splicer 10 including paper, film, foil, laminate, etc.

As noted above, the web 14 from the expiring roll 16 moves along a substantially horizontal path of travel to and through the splicer 10. More specifically, the web enters the splicer 10 by passing around an entrance idler roll 28 mounted on the splicer. Thereafter, the web 14 passes around an exit idler roll 32 mounted on the splicer 10 adjacent to its exit end. The web 14 is directed downwardly from the idler roll 32 to a second exit roll 34 mounted between two of the legs 12 of the splicer 10. The web 14 is then directed along a generally horizontal path to the entrance roll 36 in a festoon 38. Upon exiting from the festoon, the web 14 travels to a web utilization apparatus which may be, for example, a printing press, not shown.

The festoon 38 is of conventional design and construction. It acts as an accumulator for the running web 14 such that the web utilization apparatus does not have to be stopped when the portion of the web 14 in the splicer 10 is stopped during a splicing operation. The festoon 38 includes upper and lower sets of rolls 42 and 44, respectively, about which the web 14 passes. When the portion of the web 14 in the splicer 10 is stopped, the upper set of rolls 42 will move downwardly toward the lower set of rolls 44.

A horizontal platform 46 is mounted between the splicer 10 and the festoon 38. This platform may be used by the operator while he is preparing the web 26 for a splice. A step 48, adjacent to the platform 46, assists the operator in climbing up and down from the platform.

Figure 2:
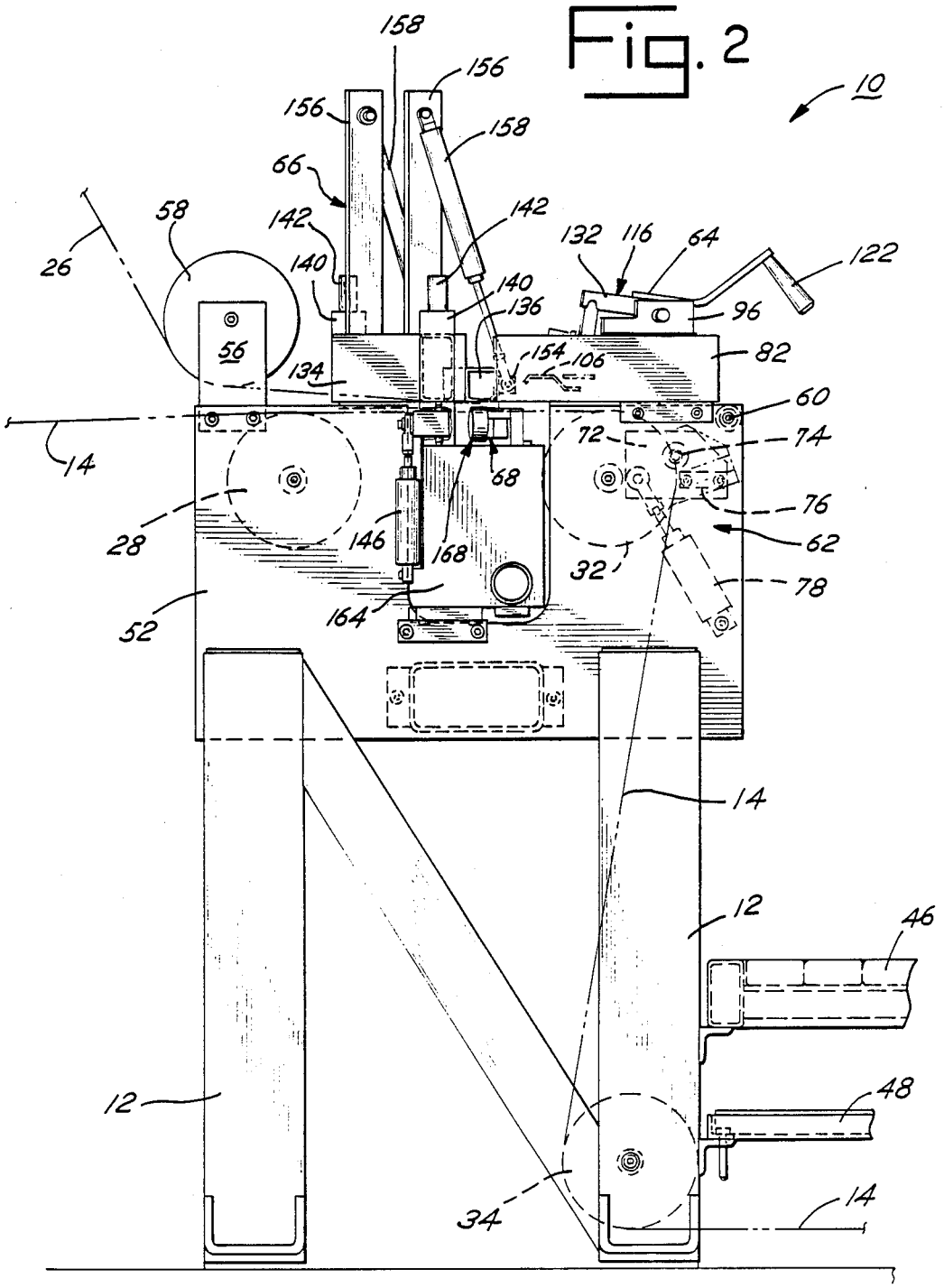
FIG. 2 is an enlarged side elevation view of the splicer shown in FIG. 1.
Figure 3:
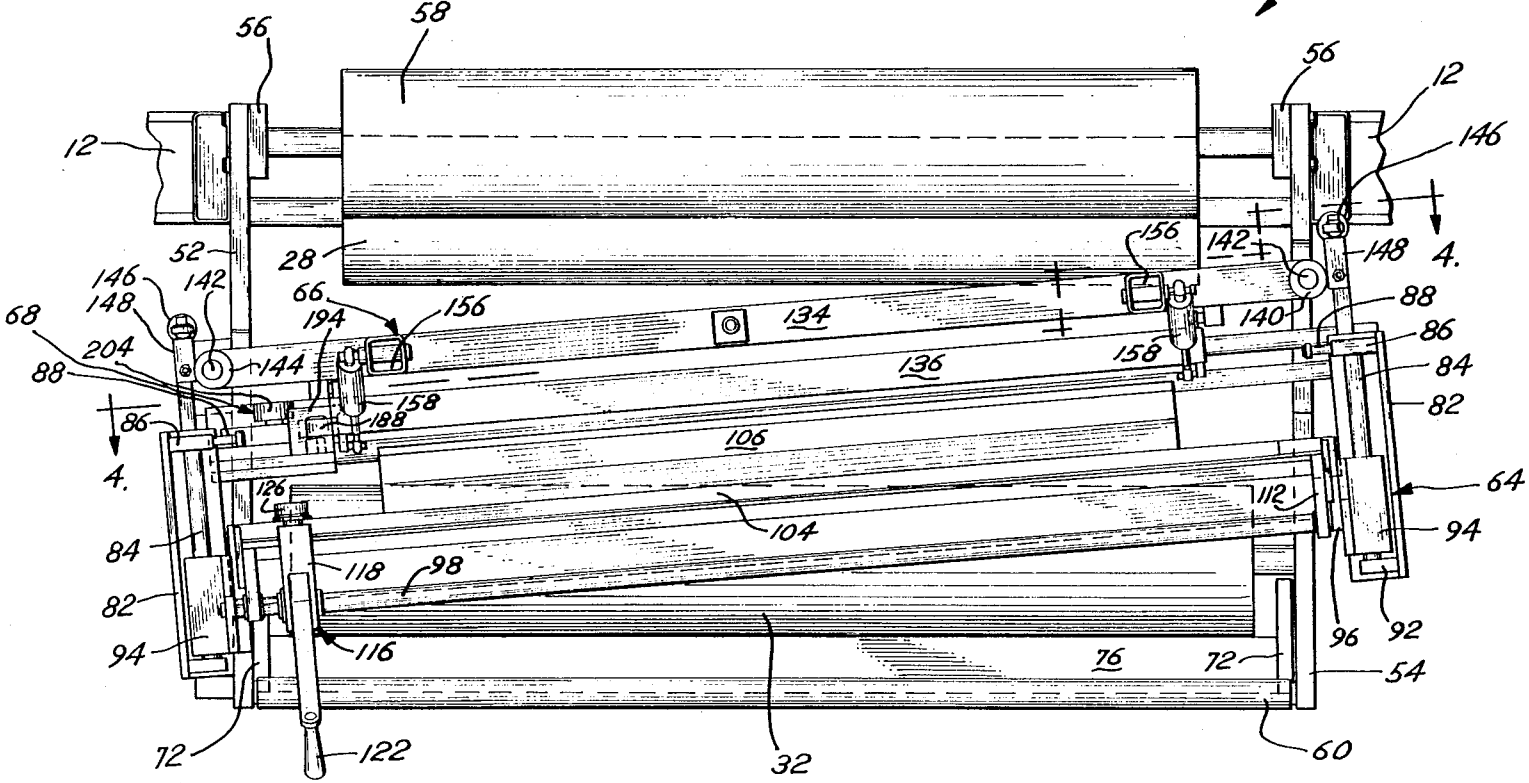
FIG. 3 is a top plan view of the splicer shown in FIG. 2.
Figure 7:
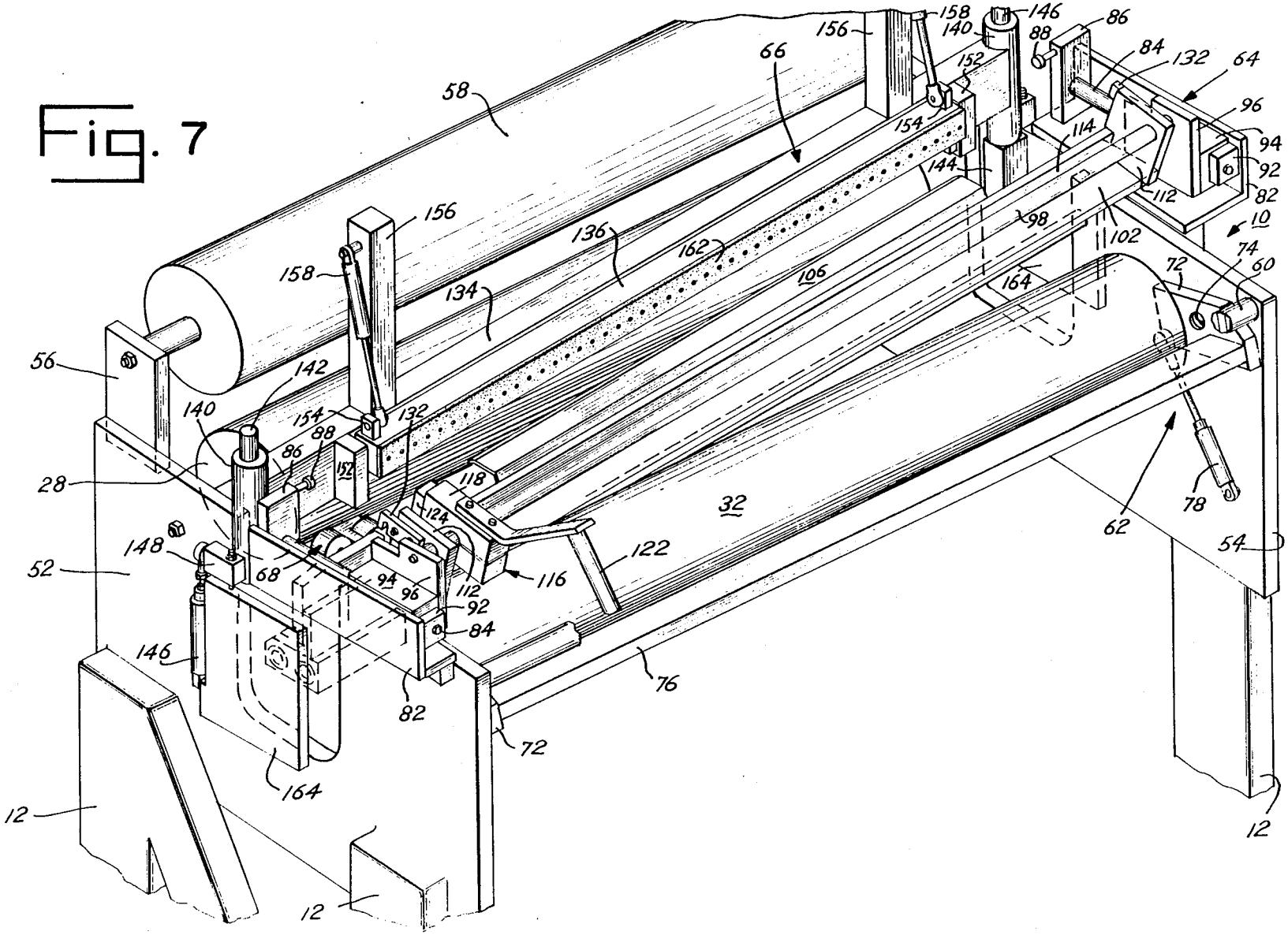
FIG. 7 is a perspective view of the exit end of the splicer shown in FIG. 1.

Referring now to FIGS. 2, 3 and 7, the splicer 10 includes two parallel, spaced apart side plates 52 and 54. The upper ends of the legs 12 are secured to the these side plates. The ends of the idler rolls 28 and 32 are journaled in the side plates.

A pair of brackets 56 are fastened, at their lower ends, to the upper, upstream corner of the plates 52 and 54 adjacent to the entrance end of the splicer 10. The other, upper ends of the brackets 56 project upwardly a short distance. The ends of an idler roll 58 are journaled in the upper ends of the brackets 56. The web 26 passes around the idler roll 58 as it travels from the roll 24, as shown in FIG. 1, into the splicer 10.

As best illustrated in FIG. 2, the splicer 10 includes: a nip assembly, shown generally at 62; a new web preparation assembly, shown generally at 64; a new web and tape holding assembly, shown generally at 66; and an web cutting and adhering assembly, shown generally at 68. Each of these assemblies 62–68 will be described in detail hereinbelow. Suffice it to say now that the nip assembly 62 serves to clamp the expiring web 14 to and about the idler roll 32 during a splicing operation. The new web preparation assembly 64 is used to prepare the leading end of the new web 26 for the splicing operation. The new web and tape holding assembly 66 is used to hold a portion of the new web 26, immediately upstream of its leading end, and to hold a strip of adhesive tape in preparation for the splicing operation and during the splicing operation itself. The web cutting and adhering assembly 68 cuts or shears the expiring web 14 during the splicing operation and causes the cut part of the trailing end of the web 14 and the leading end of the web 26 to be adhered to the adhesive tape simultaneously as the cutting of the expiring web 14 occurs.

The assemblies 64, 66, and 68 are mounted on the side plates 52 and 54, as will be described, and extend across the splicer 10 from the side plate 52 to the side plate 54. Their longitudinal axes (that is, their axes transverse to the path of travel of the web 14) are not, however, perpendicular to the path of travel of the web 14 through the splicer. Rather, these longitudinal axes are offset a small amount, for example, five degrees, from the perpendicular so that the splice, when formed, will be offset from the side edges of the joined webs.

The nip assembly 62 is best shown in FIGS. 2 and 7 and includes a pair of end plates 72. These end plates are mounted opposite each other on the inside facing surfaces of the side plates 52 and 54. They are connected at 74 to the side plates and are adapted to be pivoted, in a plane parallel to the side plates, about their aligned points of connections 74. A nip bar 76 is connected with one end of each of the plates 72. A pair of conventional pneumatic cylinders 78 are connected, at their cylinder ends, to the inside surface of the side plates 52 and 54. The rod ends of these cylinders 78 are connected with the other ends of the plates 72.

Actuation of the cylinders 78 causes the end plates 72 to pivot about their points of connection 74 and to bring the inner end of the nip bar 76 into and out of engagement with the periphery of the idler roll 32. When the cylinders 78 urge the nip bar 76 into engagement with the idler roll 32, the web 14 will be clamped between the inner end of the bar 76 and the idler roll 32.

Referring to FIGS. 2, 3, 7 and 9, the new web preparation assembly 64 is supported, at each end, by generally "L" shaped brackets 82. These brackets are, in turn, mounted on the upper ends of the side plates 52 and 54 adjacent to the exit end of the splicer 10. Each of the brackets 82 includes a horizontally disposed guide rod 84. The rods 84 are supported at their upstream or forward ends by upstanding members 86 mounted on the brackets. Coaxially aligned, inwardly directed, facing locating pins 88 are secured to the sides of the upper ends of the members 86. The downstream or rearward ends of the rods 84 are supported by members 92 that are, in turn, secured to the brackets 82.

A carrier block 94 is mounted on each of the rods 84. These blocks 94 are adapted to be slid along the lengths of the rods 84 between the members 86 and 92.

Each of the blocks 94 includes a upwardly directed, inwardly facing mounting plate 96. A guide rod 98 extends across the splicer 10. Its ends are secured adjacent to the upper, downstream corner of these mounting plates 96. An anvil member 102 extends between the mounting plates 96 and is secured, at each end, to the lower, upstream corners of these plates 96. The rod 98 and the member 102 move with the plates 96 when the carrier blocks 94 are slid along the rods 84.

A cutting element 104 is mounted along the upstream or forward edge of the anvil member 102. The upper, upstream corner edge of the element 104 is sharpened and serves as a cutting edge along which the web 26 may be cut or trimmed. The length of the cutting element is slightly longer than the width of the webs 14 and 26.

The downstream end of a shield 106 is supported below and carried by the central portion of the anvil member 102. The upstream end of the shield 106 is bent upwardly so that its distal end is substantially in the same plane as the cutting element 104 although it is spaced upstream from that element. The width of the shield 106 is less than the width of the webs 14 and 26.

Coil extension springs 108 are connected between the downstream ends of the brackets 82, beneath the member 92, and the anvil member 102. These springs 108 are stretched, as shown in FIG. 9, when the assembly 64 is moved to its upstream or first position. They thus urge the assembly 64 to return to its downstream or second position shown in FIG. 8.

A pair of pivotable plates 112 are mounted, adjacent to their upper, downstream corners, on the rod 98. The plates are disposed close to the plates 96. A nip bar 114 extends between the plates 112 and has its ends secured to the plates adjacent to their upstream, lower corners. The plates 112 are sized such that the lower edge surface of the nip bar 114 may engage the upper surface of the anvil member 102 as hereinafter described.

A trimmer subassembly 116 is also mounted on the rod 98 between the plates 112. This subassembly 116 includes a carrier block 118 that may be slid along the rod 98 in a direction parallel to the longitudinal axis of the rod. The block 118 may also be pivoted about the longitudinal axis of the rod 98. A handle 122 is secured to the upper surface of the carrier block 118 to facilitate the sliding and pivotal movement of the subassembly 116.

A member 124 is secured to the upstream facing surface of the carrier block 118. A knife wheel 126 is mounted on the upstream facing side of the member 124 adjacent to the lower end of the member 124. The wheel 126 is adapted to rotate about its central axis that is substantially perpendicular to the upstream facing surface of the member 124 and thus of the block 118. The wheel's downstream peripheral edge is beveled and sharpened so as to form a sharp cutting edge. The wheel 126 is positioned so that its sharpened downstream edge can cooperate with the upstream cutting edge of the element 104 as hereinafter described.

A downstream facing roller bearing 128 is mounted on the downstream facing side of the member 124. Its axis of rotation is parallel with the axis of rotation of the wheel 126. This bearing 128 is positioned so that it may ride along the upper surface of the nip bar 114. The bearing 128 facilitates the sliding of the carrier block 118 along the rod 98.

A pair of pin latching members 132 are secured to the upstream, inside upper corners of the pivotal plates 112. The upstream ends of these members 132 project upstream beyond the upstream ends of the plates 112. Notches are formed in these upstream ends of the members 132 and are sized so that the adjacent locating pins 88 may be received within the notches.

Figure 8:
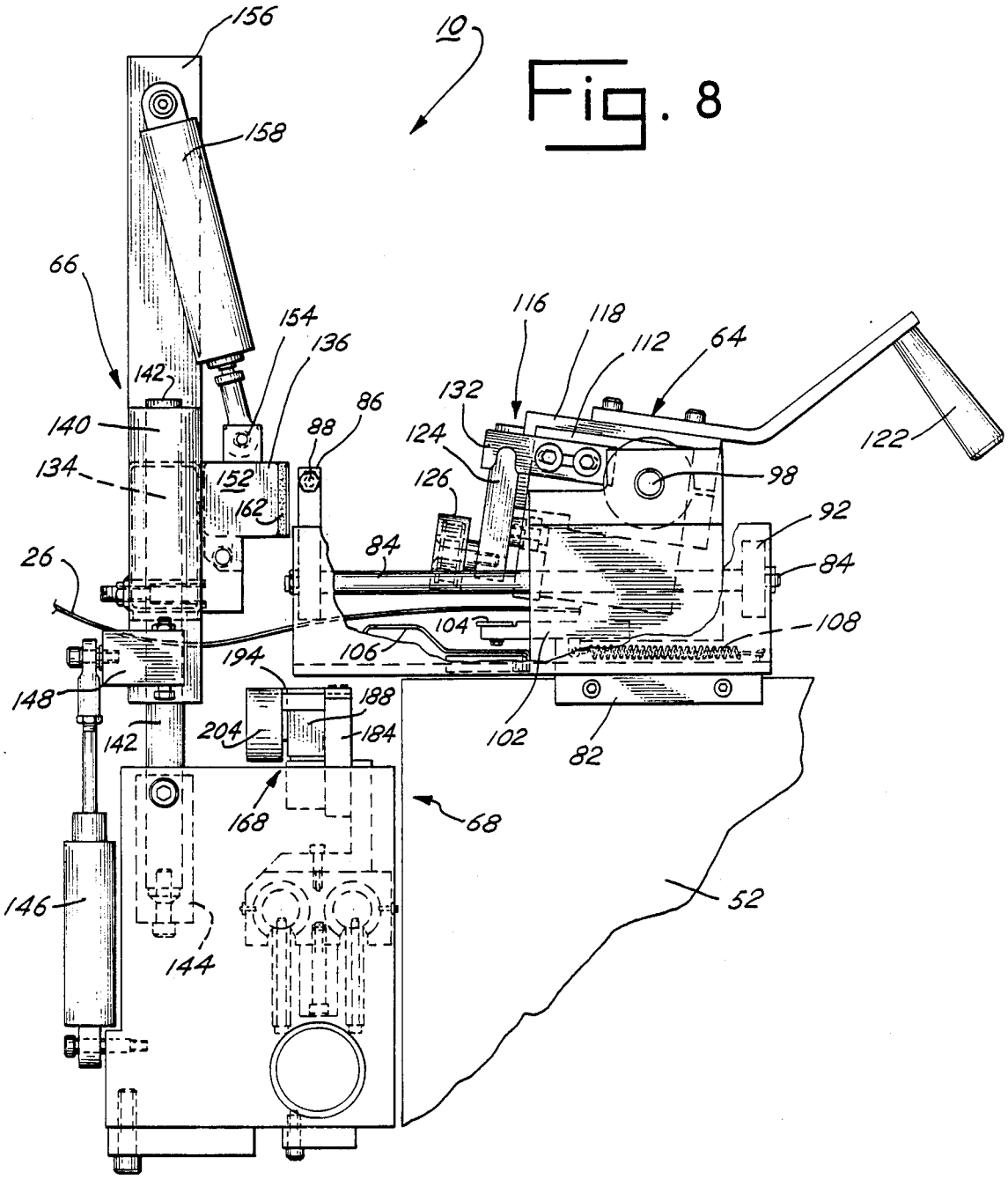
FIG. 8 is an enlarged, partial side elevational view of the upper part of the splicer shown in FIG. 1 showing, with parts broken away, the leading portion of the new web being fed into the splicer.
Figure 9:
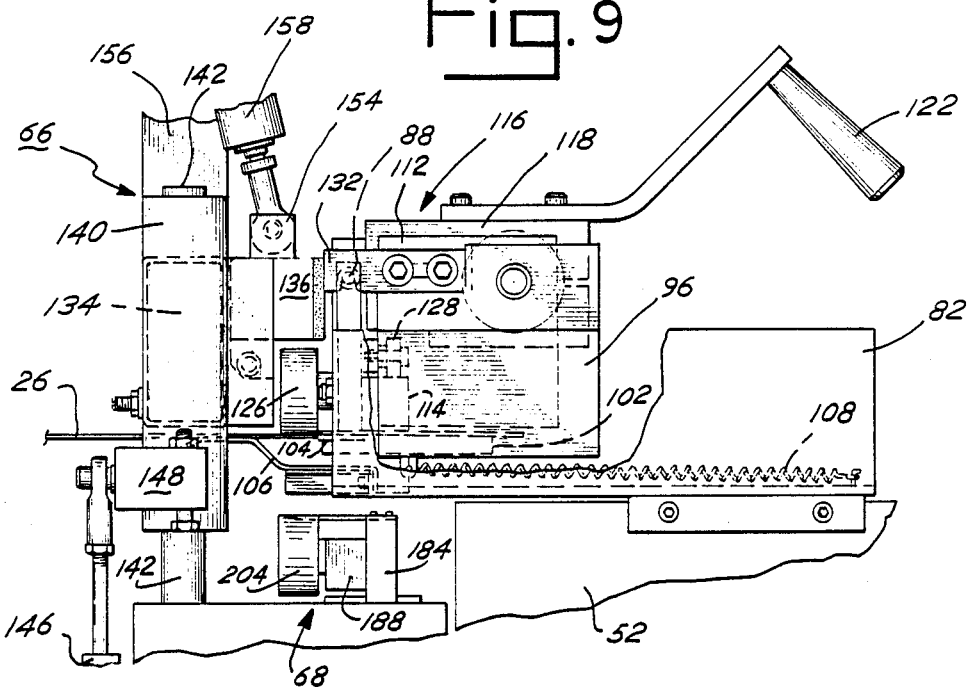
FIG. 9 is an enlarged partial side elevational view of the upper part of the splicer shown in FIG. 1 and showing the web preparation assembly in its first position to trim the leading end of the new web.

As noted, the assembly 64 is adapted to be moved between a first or upstream position, such as shown in FIG. 9, and a second or downstream position, such as shown in FIG. 8. When preparing the leading portion of the web 26 from the new roll 24 for a splice, the web 26 is led around the idler roller 58 and to and over the anvil plate 102. The operator then grasps the handle 122 and slides the assembly 64, along the rods 84, to its first position. Still using the handle 122, the subassembly 116 is then rotated counterclockwise about the longitudinal axis of the rod 98 to its "down" or cutting position as shown in FIG. 9. In this cutting position, the notches in the members 132 fit over the locating pins 88. The locating pins 88 are set so that when this occurs, the sharpened beveled edge of the wheel 126 is adjacent to and in cooperative engagement with the upstream cutting edge of the cutting element 104. Similarly, when the subassembly 116 is pivoted to its cutting position, the lower surface of the nip bar 114 clamps the adjacent, underlying portion of the web 26 against the upper surface of the anvil member 102. The operator thereafter slides the handle 122, and thus with the entire trimmer subassembly 116, along the rod 98 while continuing to hold the subassembly 116 in its cutting position. This sliding movement of the subassembly 116 results in the web 26 being cut by the rotation of the knife wheel 126 along the upstream edge of the cutting element 104. Hence, the resulting leading end of the web 26 is aligned with and congruent to the upstream edge of the cutting element 104.

Because of the cooperation between the locating pins 88 and the notches in the members 132, the cutting edge of the element 104 is always precisely located (that is, in the same vertical plane) vis-a-vis the assemblies 66 and 68, when the assembly 64 is in its first position. This assures that the leading end of each new web, like the web 26, will be located in the same vertical plane after being cut or trimmed by the web preparation assembly 64.

The assembly 64 may be moved to its second or downstream position by the operator pivoting the handle 112, and thus the trimmer subassembly 116 in a clockwise direction to its "up" or non-cutting position. This raises the notches in the members 132 off the pins 88. The operator, assisted by the springs 108, will thereafter return the assembly 64 to its second position. The springs 108 serve to retain the assembly 64 in that position.

Again referring to FIGS. 2, 3, and 7 through 11, the new web and tape holding assembly 66 includes first and second vacuum bars or tubes 134 and 136 having generally rectangular crosssections. The longitudinal axes of the tubes 134 and 136 are parallel.

The bar 134 extends across the splicer 10. Annular collar members 140 are formed on the ends of the tube 134 and are adapted to slidingly receive the upper ends of vertical guide posts 142. The lower ends of the guide posts 142 are secured to members 144 that, in turn, are secured to the side plates 52 and 54.

Conventional pneumatic cylinders 146 are secured to the outside surface of the plates 164 adjacent to the posts 142. More specifically, the cylinder ends of these cylinders 146 are secured to the plates while their rod ends are connected, through blocks 148, with the annular collar members 140. Actuation of the cylinders 146 results in the movement of the vacuum bar 134 up and down along the posts 142.

The vacuum bar 136 is shorter in length than the bar 134. Its ends are journaled for pivotal movement in blocks 152 that are secured to the downstream facing side of the vacuum bar 134. A pair of flanges are integrally formed on the upwardly facing side, as shown in FIG. 7, of the vacuum bar 136 adjacent to the blocks 152. A pair of support towers 156 are secured, at their lower ends, to the upper surface of the bar 134 intermediate its ends. These towers project upwardly above the bars 134 and 136.

Figure 10:
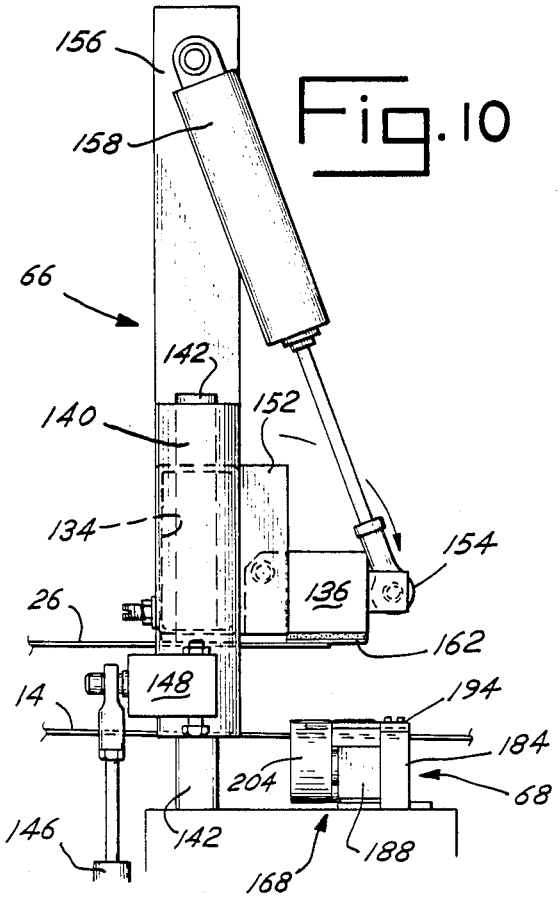
FIG. 10 is an enlarged, partial side elevational view of the new web and tape holding assembly of the splicer shown in FIG. 1.
Figure 11:
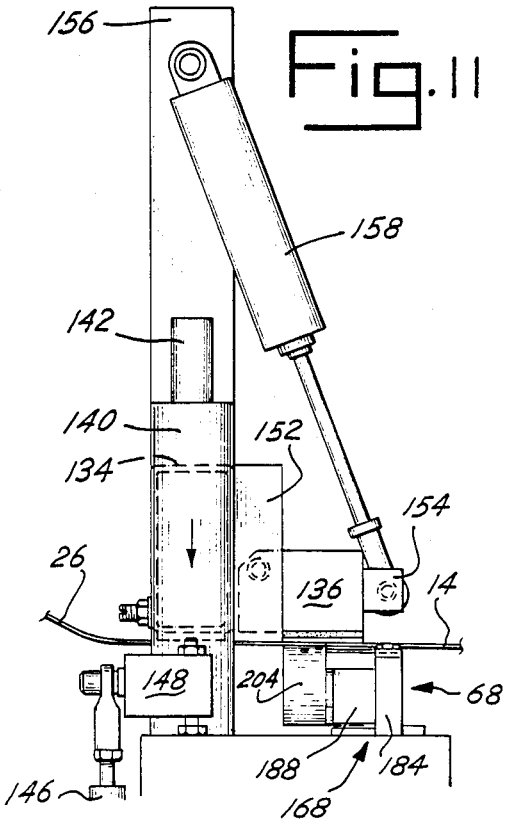
FIG. 11 is a partial side elevational view, similar to that of FIG. 10, but showing the web and tape holding assembly in its second or lower position.

Conventional pneumatic cylinders 158 are connected, at their cylinder ends, with the upper ends of these support towers. The rod ends of the cylinders 158 are connected, by pins, with the flanges 154. Actuation of the cylinders 158 causes the vacuum bar 136 to pivot, through an arc of 90°, from a first position, as shown in FIG. 7, to a second position, as shown in FIGS. 10 and 11.

The interiors of the vacuum bars 134 and 136 are connected with a conventional vacuum pump, not shown, by conventional tubing, also not shown. Operation of the vacuum pump causes a "vacuum" to be drawn within the interior of these bars.

The downwardly facing or lower surface of the bar 134 includes a plurality of small holes in the area adapted to overlie the webs running through the splicer 10. A layer of resilient material, such as rubber, is secured to the lower surface of the vacuum bar 134. This resilient layer includes similar small holes which coincide with the holes in the lower surface of the vacuum bar so that these holes permit air communication between interior and exterior of the bar 134. When a portion of the new web 26 is brought into surface to surface contact with the lower surface of the vacuum bar 134, the vacuum within that bar is sufficient to hold the portion of the web 26 tightly against the lower surface.

Similarly, the vacuum bar 136 includes a surface 162 that faces downstream when the bar is in its first position and faces downwardly when the bar is in its second position. The bar 134, is constructed so that when it is in its second position, the vertical plane, that includes the cutting edge of the element 104 when the web preparation assembly 64 is in its first position, bisects the surface 162 so as to divide the surface 162 into a downstream half and an upstream half.

The surface 162 has a plurality of small holes therein that permit air communication between the interior and exterior of the bar. The holes are in the area adapted to overlie the webs 14 and 26 when the bar 136 is in its second position. A layer of resilient material, such as rubber, is also secured to the surface 162. Holes in the resilient layer are aligned with the holes in the surface 162 so that the vacuum within the bar 136 may communicate with the exterior of the bar.

When the web 14 is running and before a splice is initiated, the assembly 66 is normally in its upper position with the vacuum bar 136 rotated to its first position, as shown in FIG. 7. When in this position, the lower surface of the bar 134 is approximately $1\frac{3}{4}$ inches above the web 14 as it runs through the splicer 10. In preparation for a splice, the operator places a strip of adhesive tape, adhesive face out, against the downstream facing surface 162. The strip is aligned on the surfaces 162 so that its ends will coincide with the side edges of the webs 14 and 26 and so that approximately one-half of it overlies the downstream half of the surface 162 and the other half of it overlies the upstream half of the surface 162. The vacuum within the bar 136 holds the strip of tape in place. When the assembly 66 is moved to its lower position during the course of a splice (and the bar 136 is rotated to its second position as shown in FIG. 11), the lower surface of the tube 136 and the surface 162 lie in a common, horizontal plane which may be approximately 3/16 of an inch above the web 14.

Figure 5:
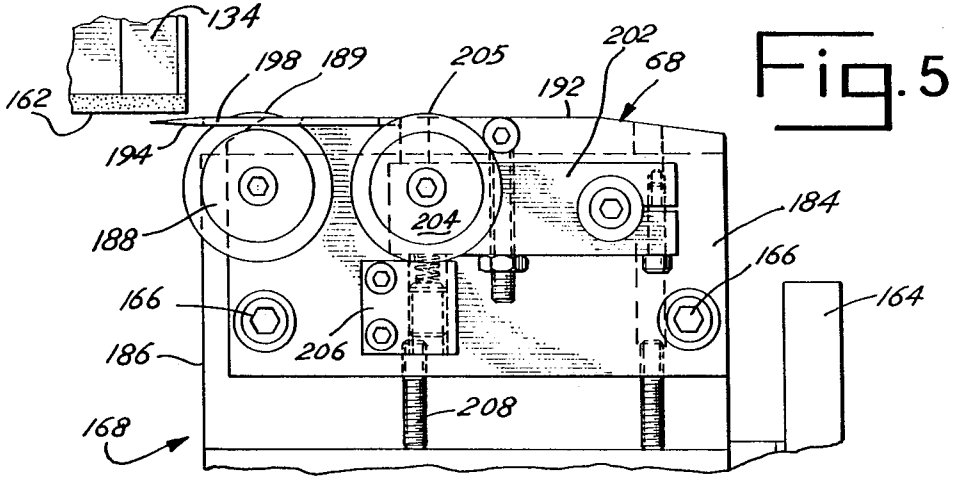
FIG. 5 is an enlarged view of the part of the splicer designated by the line 5 in FIG. 4.
Figure 6:
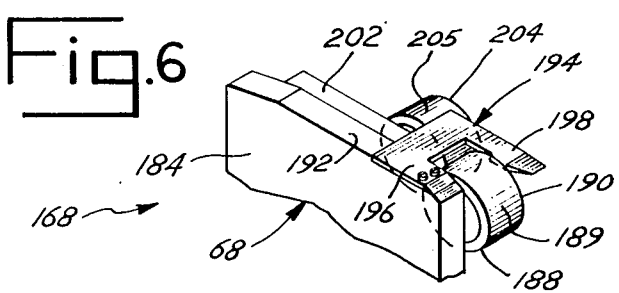
FIG. 6 is an enlarged, partial perspective view of the web cutting and adhering assembly of the splicer shown in FIG. 1.
Figure 4:
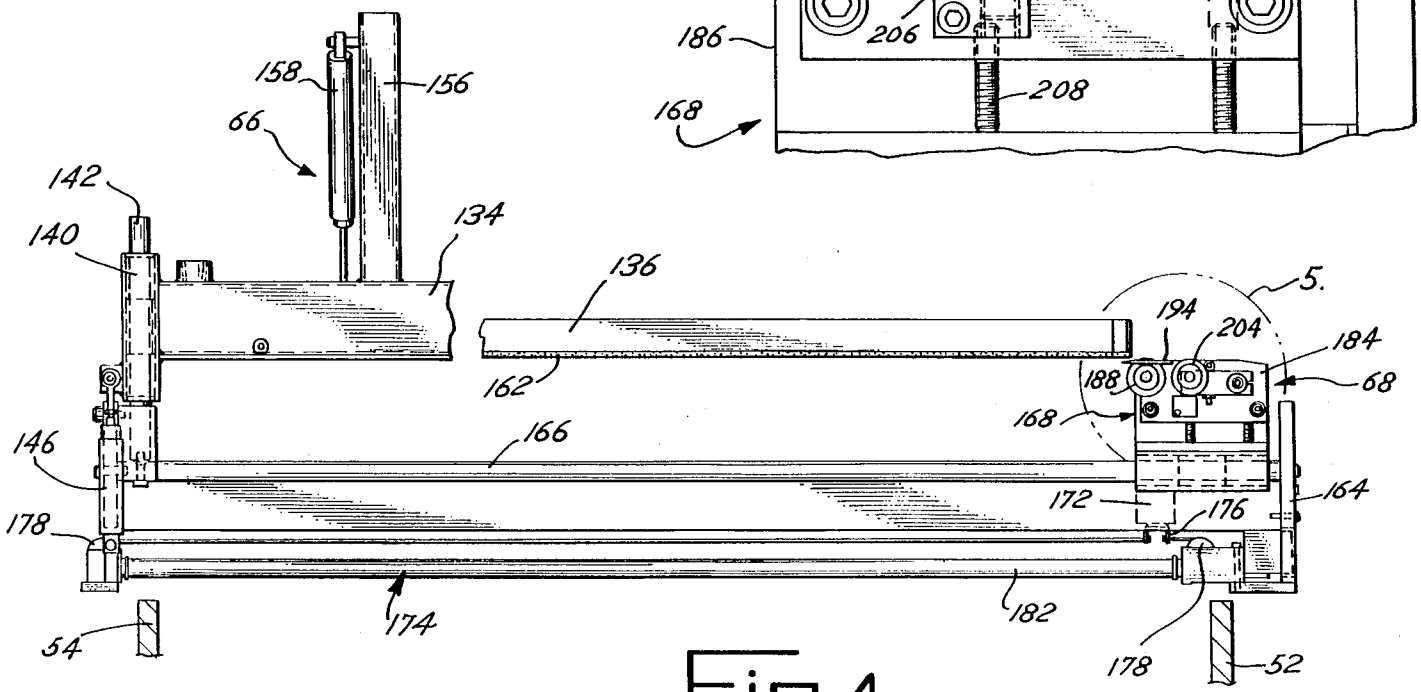
FIG. 4 is a cross-sectional view taken along the line 4—4 in FIG. 3.

The web cutting and adhering assembly 68 is best illustrated in FIGS. 4–6, and includes a pair of brackets 164 secured to the outside surfaces of the side plates 52 and 54. A pair of rods 166 extend between these brackets 164 and have their ends secured to them. The longitudinal axes of the rods 166 are parallel to the longitudinal axes of the vacuum bars 134 and 136. The rods 166 are spaced well below the path of travel of the web 14.

A wheel and knife carrier subassembly 168 is mounted on the rods 166 and is adapted to slide along the rods. Before a splice is initiated, this subassembly is positioned adjacent to the side plate 52 as shown in FIG. 4.

A block 172 depends from the lower surface of the subassembly 168. The lower end of the block 172 is connected with the opposite ends of a conventional cable cylinder 174 by means of a U-shaped member 176. The cable cylinder 174 includes cables that are connected with the member 176 and extend around guide rollers 178 mounted at opposite ends of cylinder 182. The other ends of the cables are connected with a piston, not shown, positioned and slidable within the cylinder 182. An example of such a cable cylinder is the Model No. S100-¾-AT cylinder manufactured by Tol-O-Matic, Inc., of Minneapolis, Minn.

When the cable cylinder 182 is actuated, the piston within the cylinder 182 fires. This causes the subassembly 168 to be moved, at a high velocity, along the rods 166 and across the adjacent path of travel of the web 14.

As best seen in FIGS. 5 and 6, the wheel and knife carrier subassembly 168 includes a first, vertically disposed plate 184. The upstream facing surface of the plate 184 is parallel with the longitudinal axis of the rods 166. Before a splice is initiated, the inwardly facing end 186 of the plate 184 is disposed adjacent to the side edge of the web 14 as that web moves through the splicer 10.

A first wheel 188 is mounted on the upstream facing surface of the plate 184 adjacent to its upper inner corner. The wheel has an annular peripheral surface 189 having a width, in a direction parallel to its axis of rotation, substantially equal to one-half of the width of the surface 162. The wheel 188 is adapted to rotate about an axis of rotation which is perpendicular to the plane of the upstream facing surface of the plate 184. The upstream side, annular peripheral edge 190 of the surface 189 of the wheel 188 is beveled and sharpened so that this annular edge serves as a rotatable knife blade. The upper portion of the annular peripheral surface 189 of the wheel projects slightly above the plane of the upper surface 192 of the plate.

A generally "J" shaped knife member 194 is mounted on the upper surface 192 of the plate 184. More specifically, the shorter leg 196 of the "J" shaped member 194 is secured, as for example, by bolts, at the inner corner of the surface 192. The longer leg 198 of the member 194 has a downstream edge that is disposed closely adjacent to the edge 190 of the wheel 188. The distal end of the longer leg 198 projects inwardly beyond the innermost extending annular peripheral surface of the wheel 188 and has a leading, chiseled edge. The distal end of the leg 198 is adapted to extend between the webs 14 and 26 even after the assembly 66 has been moved down to its lower position.

When a splice is to be made and the web 14 is to be cut (that is, when the subassembly 168 is to be moved rapidly across the web), the upper portion of the peripheral surface 189 of the wheel 188 initially engages the adjacent end of the surface 162 of the vacuum bar 136. (The wheel 188 is aligned so that its peripheral surface 189 only engages the downstream half of the surface 162). This engagement causes the wheel to rotate in a clockwise direction as seen in FIGS. 4 and 5. As the subassembly 168 and thus wheel 188 continue to move along the rod 166, the web 14, starting with its adjacent side edge, contacts the peripheral surface 189 of the rotating wheel and is cut or sheared, at a moving point of cutting defined by the cooperation between the beveled edge 190 of the wheel 188 and the adjacent part of the downstream facing edge of the leg 198. The cut part of the trailing or downstream end of the web 14 (that is, the part immediately behind the moving point of cutting) moves up and over the upper portion of the peripheral surface 189 of the wheel 188. The cut part of upstream end of the web 14 drops down, by gravity, below the subassembly 168 and out of the open bottom of the splicer 10. The high velocity movement of the subassembly 168 across the web 14 rapidly cuts the web, a part at a time, from one side edge to the other.

A second, smaller plate 202 is mounted on the upstream side of the plate 184 to the outside of the wheel 188. A second wheel 204 is mounted on the upstream side of this second plate. The wheel 204 is mounted for rotation about an axis parallel to but spaced outwardly from the axis of rotation of the wheel 188. Like the wheel 188, the wheel 204 has an annular peripheral surface 205 that has a width, in the direction parallel to its axis of rotation, substantially equal to one-half of the width of the surface 162. The wheel 204 is aligned so that its peripheral surface 205 only engages the upstream half of the surface 162. Also like the wheel 188, the upper portion of the annular peripheral surface of the wheel 204 projects above the upper edge surface 192 of the plate 186. A coil compression spring 206 biases the plate 202 and thus the wheel 204 upwardly. A set screw 208 is adapted to adjust the tension on the spring 206 so that the upper portion of the peripheral surface 205 of the wheel is slightly higher than the upper portion of the peripheral surface 189 of the wheel 188.

As noted, the wheel 204 is aligned so that its upper portion of its peripheral surface 205 will engage the upstream half of the surface 162 of the bar 136 when the assembly 66 is in its lower position as shown in FIG. 11 and when the subassembly 168 moves across the path of travel of the web 14. When the wheel 204 first engages the surface 162, the wheel is forced slightly downwardly against the bias of the spring 206. This causes the wheel to exert a stronger line of pressure on the surface 162 as the wheel moves across the vacuum bar 136.

The method of performing a splice with a splicer 10 may be summarized as follows: When the web 14 from the expiring roll 16 is in the process of running through the splicer 10, the nip assembly 62 is not actuated; the new web preparation assembly 64 is in its second or downstream position, as shown in FIGS. 2 and 8; the new web and tape holding assembly 66 is in its upper position as shown in FIGS. 8 and 9; and the wheel and knife carrier subassembly 168 is positioned adjacent to the side plate 52. To prepare for a splice, the operator climbs on the platform 46 and applies a strip of adhesive tape, adhesive face out, to the surface 162 of the vacuum bar 136. The vacuum within the bar holds that strip of tape to the surface 162. The operator selects the length of the strip of tape so that its length is substantially equal to the width of web 26 along the intended splice line. The width of the tape is wide enough so that the tape covers both the upstream and downstream halves of the surface 162.

The operator next feeds in the leading portion part of the web 26 from the new roll 24 around the idler roll 58, past the assembly 66 and back between the upper surface of the anvil member 102 and the lower surface of the nip bar 114 of the assembly 64. The end of the web 26 may be easily threaded between the anvil 102 and the nip bar 114 since the trimmer subassembly 116 is in its non-cutting position, as shown in FIGS. 2 and 8, due to coil extension springs, not shown, which biases it to that position. He then generally aligns the side edges of the web 26 with the side edges of the running web 14.

The operator next grasps the handle 122 and moves the assembly 64 forward toward its first or upstream position. When that position is reached, he moves the handle 122 upwardly. This pivots the trimmer subassembly 116 counterclockwise, about the axis of the rod 98, to its cutting position and so as to hook the notches in plates 132 over the locating pins 88. The rotation of the trimmer subassembly 116 causes the bottom of the nip bar 114 to clamp the web 26 against the anvil member 102.

The upstream movement of the assembly 64 has additionally caused the shield 106 to engage the underside of the web 26 and press a portion of this web upwardly against the lower surface of the vacuum bar 134. The vacuum in that bar thereafter holds this portion of the web 26 tightly against the lower surface.

The operator next slides the trimmer subassembly 116 along the rod 98 from one side to the other. This causes the wheel 126 to move along the cutting edge of the element 104. The relative movement between the cutting edge of the wheel 126 and the element 104 results in the web 26 being trimmed or cut. As noted, this trimmed leading end of the web 26 is aligned with and congruent with the cutting edge of the element 104. The trimmed leading end of the web 26 is also spaced preselected distance downstream from the portion of the web 26 held by the vacuum bar 134 due to the cooperation between the pins 88 and the notches in the plates 132.

During this trimming of the leading end of the web 26, the vacuum bar 136 remains in its first or upper position. Thus, the strip of tape is held up out of any contact with the assembly 64.

After the leading end of the web 26 has been trimmed, the assembly 64 is returned to its second or downstream position. This is done by the operator pivoting the handle 122 in a clockwise direction so that the notches in the plates 132 lift off the locating pins 88. The assembly 64 then moves to its second position under the bias of the springs 108. When in its second position, the assembly 46 is relatively remote from the assemblies 66 and 68 and does not interfere with the subsequent steps in the splicing operation.

When a splice is to be initiated, the movement of the web 14 through the splicer 10 is brought to a stop by actuating the brakes for the rolls 16 and 24. The application of these brakes halts the movement of the portion of the web 14 in the splicer 10. Nevertheless the web 14, downstream from the festoon 38, continues to run, without any loss of speed or tension, to the web utilization apparatus.

After the portion of the web 14 in the splicer 10 is stopped, its lack of movement is sensed by conventional sensors, not shown, that may then initiate the splicing operation. Alternatively, the splicing operation may be initiated manually by the operator.

At the start of the splicing operation, the cylinders 78 are actuated so that the nip bar 76 clamps the web 14 against the roll 32. The web 14 is thus held under tension between the idler roll 32 and the roll 16.

At the same time, the cylinders 158 and 146 are actuated. This causes the bar 136 to be rotated to its second or down position, and the bars 134 and 136, and thus the web 26 and strip of adhesive tape, to be moved downwardly to their lower positions.

The cable cylinder 174 is then fired resulting in the wheel and knife carrier subassembly 168 being rapidly moved across the web 14 from one of its side edges to the other. Although the web 26 has been moved into close proximity with the web 14, the distal end of the leg 198 of the member 194 projects between the webs to assure that the webs remain separate as the subassembly 168 moves across the web 14.

The subassembly 168 is positioned, vis-a-vis the vacuum bar 136, so that the upper portions of the peripheral surfaces 189 and 205 of the wheels 188 and 204 come into contact with the surface 162 of the bar 136 just prior to the time that the wheel 188 and knife member 194 first contact the side edge of the web 14. Due to this initial contact with the surface 162, both wheels 188 and 204 are already rotating, in a clockwise direction, by the time there first is contact between the web 14 and the wheel 188 and the knife member 194. As noted above, the web is cut or sheared at the point where the web contacts sharpened, beveled edge 190 of the wheel 188 and the adjacent part of the leg 198 of the knife member 194. As a result, the point of cutting of the web 14 moves across the web, from one side edge to the other, as the subassembly 168 moves across the web. The uncut part of the web 14 (that is, the part ahead of the subassembly 168) remains under tension. The cut part of the web 14, immediately downstream from this point of cutting, rides up and over the upper portion of the peripheral surface 189 of the wheel 188 and is thereby pressed, by this upper portion, against the vertically adjacent portion of the downstream half of the face of the adhesive tape held on the surface 162. Because the area of contact between the upper portion of the wheel 188 and the surface 162 is, at any one time, very small, almost just a line of contact, the amount of force required to adhere the just cut part of the web 14 to adhesive tape is relatively small particularly as compared with the tape bar mechanisms used in prior splicers.

At almost the same time that the wheel 188 is adhering the cut downstream trailing end of the web 14 to the downstream half of the strip of tape, the upper portion of the peripheral surface 205 of the wheel 204 is similarly adhering the adjacent part (that is, the part immediately upstream from the just cut part of the web 14) of the trimmed leading end of the web 26 against the vertically adjacent part of the upstream half of the adhesive tape held on the surface 126. Again, only a very small part of the web 26 is pressed, at any one time, against the adhesive tape due to the limited line of contact between the upper portion of the surface 205 of the wheel 204 and the surface 162. These lines of contact between the upper peripheral portions of the wheels 204 and 188, on the one hand, and the surface 162, on the other hand, move across the entire webs and strip of tape as the subassembly 168 moves across the web 14.

As soon as the subassembly 168 completes its travel across the web 14 (that is, as soon as the strip of tape has joined the leading end of the web 26 and the cut downstream end of the web 14), the brakes for the rolls 24 and 16 are released, and the cylinder 78 in the nip assembly is again actuated so that the nip bar 76 is moved away from the periphery of the idler roller 32. At the same time, the cylinders 146 are actuated so as to move the assembly 66 upwardly to its upper or first position. At this same time, the vacuum in the bars 134 and 136 may be reduced or momentarily eliminated. The newly spliced web 14–26 immediately begins to accelerate under the force of the web 14 being pulled through the festoon 38.

Thereafter, roll 16 is replaced by another new roll and the roll 24 is rotated to the position occupied by the roll 16 as shown in FIG. 1. Before this occurs (that is, while the running web 26 is still passing around the idler roll 58), the subassembly 168 will return to its original position, adjacent the side plate 52, so as to avoid any possibility that the subassembly might contact the running web 26. Preparation for another splice may then commence.

We claim:

1. An improved apparatus for forming a butt splice adapted to join together a web, which is from an expiring roll of material supported in a first roll supporting position and which is being run downstream from the expiring roll under tension along a predetermined path of travel that includes an initial substantially horizontal section and then proceeds to a running web storage means, to a web which is from a new roll, which is initially supported in a second roll supporting position above the expiring roll, and which is moved, while the new web is being run off, to the first roll supporting position, the improved apparatus comprising:

means disposed adjacent to the substantially horizontal section of the path of travel for holding a portion of the new web in a first position above the expiring web as the expiring web is running along the substantially horizontal section of the path of travel;

first means, including an anvil having a transverse cutting edge extending across the substantially horizontal section of the path of travel, for trimming the leading end of the new web along the cutting edge of the anvil when the first means is positioned in a first position adjacent to the downstream end of the held portion of the new web so that a trimmed, leading end is formed on the new web a preselected distance downstream from the held portion of the new web and so that the trimmed leading end of the new web is aligned with and congruent to the cutting edge of the anvil;

means for moving the first means between its first position and a second position wherein the first means is remote from the held portion of the new web and the path of travel;

means for holding a strip of tape, adhesive face out, in a first position above and spaced from the expiring web roll as the expiring web is running along the substantially horizontal path of travel, with the strip of adhesive tape having a length substantially equal to the width of the new and expiring webs;

means for momentarily stopping the running of the portion of the expiring web in the substantially horizontal section while permitting the other portions of the expiring web downstream from the substantially horizontal section to continue to run under tension;

means for moving the means for holding the portion of the new web between its first position and a second position that is closely adjacent to the stopped portion of the expiring web;

means for moving the strip of adhesive tape between its first position and a second position that is closely adjacent to the stopped portion of the expiring web, so that in its second position, a first, upstream part of the strip of adhesive tape overlies the trimmed leading end of the new web and so that a second, downstream part of the strip of adhesive tape extends downstream beyond the vertical plane of the cutting edge of the anvil when the first means is in its first position;

means for trimming the stopped portion of the expiring web by cutting the stopped portion of the expiring web a part at a time, across the expiring web and beginning at one side edge thereof, so that the point of cutting moves across the stopped portion of the expiring web from the one side edge to the other side edge, so that the uncut part of the expiring web remains under tension ahead of the point of cutting, and so that the trimmed trailing end of the stopped portion of the expiring web is aligned with and congruent to the vertical plane of the cutting edge of the anvil when the first means is in its first position;

means for adhering the cut part of the trimmed trailing end of the stopped portion of the expiring web, immediately behind the point of cutting, to the vertically adjacent portion of the second part of the face of the adhesive tape and for adhering the part of the trimmed leading end of the new web, that is adjacent to the just cut part of the trimmed trailing end of the expiring web, to the vertically adjacent portion of the first part of the face of the adhesive tape, simultaneously as the point of cutting moves across the stopped portion of the expiring web so that the trimmed leading end of the new web abuts and is disposed closely adjacent to the trimmed trailing end of the stopped portion of the expiring web and so that the adhesive tape secures together the trimmed leading end of the new web and the trimmed trailing end of the expiring web; and means for permitting the joined leading end of the new web and trailing end of the expiring web to run again, along the substantially horizontal section of the path of travel, with the downstream portions of the expiring web as soon as all of the trimmed leading end of the new web and the trimmed trailing end of the expiring web are adhered together by the strip of adhesive tape.

2. The improved apparatus of claim 1 wherein the vertical plane of the cutting edge of the anvil, when the first means is in its first position, substantially bisects the strip of adhesive tape when the strip of adhesive tape is in its second position.

3. The improved apparatus of claim 2 wherein the means for holding a portion of the new web includes a vacuum bar that extends transversely across the substantially horizontal section of the path of travel at an angle with respect to the substantially horizontal section of the path of travel; and wherein means for holding a strip of tape includes a second vacuum bar that extends transversely across the substantially horizontal section of the path of travel and is disposed at the angle with respect to the substantially horizontal section of the path of travel.

4. The improved apparatus of claim 3 wherein the second vacuum bar is pivotably mounted on and carried by the first vacuum bar; wherein the portion of the second vacuum bar that holds the strip of tape faces horizontally downstream, with respect to the substantially horizontal section of the path of travel, when the strip of tape is in its first position and faces downwardly toward the new and expiring webs when the strip of tape is in its second position; and wherein the first vacuum bar and the second vacuum bar are movable together vertically, with respect to the new and expiring webs, when the means for holding the portion of the new web is moved between its first and second positions.

5. The improved apparatus of claim 2 wherein the means for moving the first means between its first position and its second position causes the first means to be moved above and with respect to the substantially horizontal section of the path of travel; wherein the means for trimming the new web along the cutting edge of the anvil includes a manually operable cutting means that is movable between a cutting position and a noncutting position; and wherein the cutting means may be moved along the cutting edge of the anvil transversely across the substantially horizontal section of the path of travel.

6. The improved apparatus of claim 5 wherein the first means includes means for clamping a leading portion of the new web downstream from the cutting edge of the anvil when the first means is in its first position and the cutting means is in its cutting position.

7. The improved apparatus of claim 6 wherein the first means includes a shield that projects upstream from the vertical plane of the cutting edge of the anvil, which shield is disposed between the expiring web and the new web when the first means is in its first position, and which shield forces the held portion of the new web up against the means for holding the portion of the new web when the first means and the means for holding the portion of the new web are in their first positions.

8. The improved apparatus of claim 2 wherein the means for trimming the stopped portion of the expiring web and the means for adhering the cut part of the trimmed trailing end of the stopped portion of the expiring web includes a horizontally disposed knife member that cooperates with a first wheel having a horizontal axis of rotation and having an adjacent sharpened beveled annular peripheral cutting edge; wherein the point of cutting of the stopped portion of the expiring web is defined between the blade and the adjacent cutting edge of the first wheel as the blade and the first wheel are moved from the one side edge of the stopped portion of the expiring web to its other side edge; wherein the leading edge of the knife member is disposed above the stopped portion of the expiring web and below the new web; and wherein the just cut part of the stopped portion of the expiring web passes over the upper portion of the annular peripheral surface of the first wheel so that this upper portion of the first wheel forces that just cut part against the adjacent vertical portion of the second part of the face of the adhesive tape.

9. The improved apparatus of claim 8 wherein the means for adhering also include a second wheel which has its axis of rotation substantially parallel to the axis of rotation of the first wheel, which is disposed upstream from the first wheel and the knife member, and which is arranged so that the upper portion of the annular peripheral surface of the second wheel engages the part of the trimmed leading end of the new web, that is adjacent to the downstream just cut part of the stopped portion of the expiring web, and presses this engaged part against the adjacent vertical portion of the first part of the face of the adhesive tape, as the wheels and knife members are rapidly moved across the stopped portion of the expiring web.

10. The improved apparatus of claim 9 wherein the means for holding a portion of the new web includes a vacuum bar that extends transversely across the substantially horizontal section of the path of travel at an angle with respect to the substantially horizontal section of the path of travel; and wherein means for holding a strip of tape includes a second vacuum bar that extends transversely across the substantially horizontal section of the path of travel and is disposed at the angle with respect to the substantially horizontal section of the path of travel.

11. The improved apparatus of claim 10 wherein the second vacuum bar is pivotably mounted on and carried by the first vacuum bar; wherein the portion of the second vacuum bar that holds the strip of tape faces horizontally downstream, with respect to the substantially horizontal section of the path of travel, when the strip of tape is in its first position and faces downwardly toward the new and expiring webs when the strip of tape is in its second position; and wherein the first vacuum bar and the second vacuum bar are movable together vertically, with respect to the new and expiring webs, when the means for holding the portion of the new web is moved between its first and second positions.

12. The improved apparatus of claim 11 wherein the means for moving the first means between its first position and its second position causes the first means to be moved above and with respect to the substantially horizontal section of the path of travel; wherein the means for trimming the new web along the cutting edge of the anvil includes a manually operable cutting means that is movable between a cutting position and a noncutting position; and wherein the cutting means may be moved along the cutting edge of the anvil transversely across the substantially horizontally disposed section of the path of travel.

13. The improved apparatus of claim 12 wherein the first means includes means for clamping a leading portion of the new web downstream from the cutting edge of the anvil when the first means is in its first position and the cutting means is in its cutting position; and wherein the first means includes a shield that projects upstream from the vertical plane of the cutting edge of the anvil, which shield is disposed between the expiring web and the new web when the first means is in its first position, and which shield forces the held portion of the new web up against the means for holding the portion of the new web when the first means and the means for holding the portion of the new web are in their first positions.

14. An improved method for forming a butt splice adapted to join a web, which is from an expiring roll of material supported in a first roll supporting position and which is being run downstream from the expiring roll under tension along a predetermined path of travel that includes an initial substantially horizontal section and then proceeds to a running web storage means, to a web which is from a new roll of material, which is initially supported in a second roll supporting position above the expiring roll, and which is moved, while the new web is being run off, to the first roll supporting position, the improved method comprising the steps of:

holding a portion of the new web in a first position above the expiring web as the expiring web is running through the substantially horizontal section of the path of travel, with the side edges of the held portion of the new web being aligned with the side edges of the expiring web running beneath it;

moving an anvil means to a first position adjacent to and downstream of the held portion of the new web, with the anvil means having a transverse cutting edge extending across the path of travel;

trimming the new web along the cutting edge of the anvil means so that a trimmed leading end is formed on the new web a preselected distance downstream from the held portion of the new web;

holding a strip of adhesive tape, adhesive face out, in a first position above and spaced from the expiring web as the expiring web is running through the substantially horizontal section of the path of travel, with the strip of adhesive tape having a length substantially equal to the width of the new and expiring webs and with the ends of strip adhesive tape being aligned with the side edges of the new and expiring webs;

momentarily stopping the running of the portion of the expiring web in the substantially horizontal section while permitting other downstream portions of the expiring web, remote from the substantially horizontal section, to continue to run under tension;

moving the held portion of the new web to a second position that is closely adjacent to the stopped portion of the expiring web;

moving the strip of adhesive tape to a second position that is closely adjacent to the stopped portion of the expiring web so that in its second position, a first upstream part of the strip of adhesive tape overlies the trimmed leading end of the new web and so that a second downstream part of the strip of adhesive tape overlies and extends downstream beyond the vertical plane of the cutting edge of the anvil means when the anvil means is in its first position;

trimming the stopped portion of the expiring web along the vertical plane of the cutting edge of the anvil means, when the anvil means is in its first position, by cutting the stopped portion of the expiring web a part at a time, across the expiring web and beginning at one side edge thereof, so that the point of cutting of the stopped portion of the expiring web moves across the stopped portion of the expiring web from the one side edge to the other side edge, so that the uncut part of the stopped portion of the expiring web remains under tension ahead of the point of cutting, and so that the trimmed trailing end of the stopped portion of the expiring web is aligned with and congruent to the vertical plane of the cutting edge of the anvil means when the first means is in its first position;

adhering the cut part of the trimmed trailing end of the stopped portion of the expiring web, immediately behind the point of cutting, to the vertically adjacent portion of the second part of the face of the strip of adhesive tape and adhering the part of the trimmed leading end of the new web, that is adjacent to the just cut part of the trimmed trailing end, to the vertically adjacent portion of the first part of the face of the adhesive tape simultaneously as the point of cutting moves across the stopped portion of the expiring web so that the trimmed leading end of the new web abuts and is disposed closely adjacent to the trimmed trailing end of the stopped portion of the expiring web and so that the adhesive tape secures together the trimmed leading end of the new web and the trimmed trailing end of the expiring web and;

permitting the joined expiring and new webs to run again, along the substantially horizontal section of the path of travel, with the other downstream portions of the expiring web, as soon as all of the trimmed leading end of the new web and the trimmed trailing end of the expiring web are adhered together by the strip of adhesive tape.

15. The improved method of claim 14 wherein the vertical plane of the cutting edge of the anvil means, when the anvil means is in its first position, substantially bisects the strip of adhesive tape when the strip of adhesive tape is in its second position.

16. The improved method of claim 15 wherein the cut part of the trimmed trailing end of the stopped portion of the expiring web and the adjacent part of the trimmed leading end of the new web are pressed against the strip of adhesive tape at lines of contact that move across the expiring and new webs, from one side edge to the other, with the point of cutting.

* * * * *